US009492051B2

(12) United States Patent
Hockaday et al.

(10) Patent No.: US 9,492,051 B2
(45) Date of Patent: Nov. 15, 2016

(54) VAPOR REMOVAL SYSTEM

(76) Inventors: John David Hockaday, Bartlett, TN (US); Eldon Loyd Moss, Jr., Atoka, TN (US); Edwin Earl Duncan, III, Cordova, TN (US)

( * ) Notice: Subject to any disclaimer, the term of this patent is extended or adjusted under 35 U.S.C. 154(b) by 39 days.

(21) Appl. No.: 13/007,829

(22) Filed: Jan. 17, 2011

(65) Prior Publication Data

US 2011/0177772 A1 Jul. 21, 2011

Related U.S. Application Data

(60) Provisional application No. 61/295,291, filed on Jan. 15, 2010.

(51) Int. Cl.

| | |
|---|---|
| ***A47L 15/00*** | (2006.01) |
| ***D06F 39/00*** | (2006.01) |
| *A47L 15/48* | (2006.01) |

(52) U.S. Cl.

CPC ..... *A47L 15/0081* (2013.01); *A47L 15/0049* (2013.01); *A47L 15/488* (2013.01); *D06F 39/00* (2013.01); *A47L 15/48* (2013.01); *A47L 2401/18* (2013.01); *A47L 2501/10* (2013.01); *A47L 2501/20* (2013.01); *A47L 2501/22* (2013.01); *A47L 2501/26* (2013.01)

(58) Field of Classification Search

CPC ..... F24F 3/14; F24F 3/16; B01D 53/26; A47L 2401/19; A47L 15/0081; A47L 15/0049; A47L 2501/26; A47L 15/48; A47L 15/488; D06F 39/00

USPC ..... 454/341, 307, 337; 34/62, 75, 595, 596, 34/601–606

See application file for complete search history.

(56) References Cited

U.S. PATENT DOCUMENTS

| | | | | |
|---|---|---|---|---|
| 2,675,628 | A * | 4/1954 | O'Neil | 34/75 |
| 2,834,121 | A * | 5/1958 | Geldhof | 34/75 |
| 2,892,335 | A * | 6/1959 | Gray, Jr. | D06F 5/00 34/596 |
| 3,012,333 | A * | 12/1961 | Leonard | D06F 58/24 261/112.1 |

(Continued)

FOREIGN PATENT DOCUMENTS

| | | | | |
|---|---|---|---|---|
| DE | GB 2302398 | A * | 1/1997 | A47L 15/483 |
| EP | 0486828 | A1 | 5/1992 | |

(Continued)

*Primary Examiner* — Steven B McAllister
*Assistant Examiner* — Frances F Hamilton
(74) *Attorney, Agent, or Firm* — W. Edward Ramage; Baker Donelson

(57) ABSTRACT

An apparatus for the evacuation of warm, moist air or vapor from a dishwasher cabinet or other washing machine interior. A centrifugal fan draws the hot air and water vapor out of the washing cavity through a flue riser and discharges it into a cooling chamber with one or more cooling spray nozzles. The cooling spray nozzles spray a fine mist of cold water into the stream of heated air and vapor, and may spray at angle to the flow of the stream of heated air and vapor. As the heated air and vapor from the dishwasher and the cooling spray mix, heat is transferred from the heated air and vapor to the cold water or mist being sprayed into the air stream. This reduces the temperature of the vapors and air that was extracted from the dishwasher. As the temperature is reduced, the water vapors condense and form droplets which accumulate on the sides and bottom of the cooling flue. This reduced temperature and moisture air is then discharged to the room at an opening, which may be located slightly above the bottom of the flue cabinet, along with the condensate.

8 Claims, 5 Drawing Sheets

(56) References Cited

U.S. PATENT DOCUMENTS 3,026,628 A * 3/1962 Berger, Sr. ..... 34/231
3,038,709 A 6/1962 McDonald et al.
3,064,358 A * 11/1962 Giuffre ..... D06F 58/206 34/569
3,132,005 A * 5/1964 McMillan ..... D06F 58/24 34/569
3,285,038 A * 11/1966 Wolverton ..... D06F 39/083 137/247.13
3,598,131 A * 8/1971 Weihe, Jr. ..... 134/107
3,789,860 A * 2/1974 Katterheinrich et al. ..... 165/47
3,876,469 A * 4/1975 Schimke ..... A47L 15/488 134/95.2
4,112,590 A * 9/1978 Muller ..... D06F 58/24 34/596
5,042,171 A * 8/1991 Obata ..... D06F 58/24 34/604
5,207,764 A * 5/1993 Akabane ..... D06F 5/00 34/596
5,443,624 A * 8/1995 Claesson ..... 95/113
6,170,166 B1 * 1/2001 Johansen ..... A47L 15/48 34/595
7,204,039 B2 * 4/2007 Cho ..... D06F 58/24 34/596
7,204,040 B2 * 4/2007 Myung ..... D06F 58/04 34/134
7,254,967 B2 * 8/2007 Kim ..... D06F 58/24 68/19.2
RE40,123 E * 3/2008 Johansen et al. ..... 34/62
7,448,146 B2 * 11/2008 Cho ..... B01D 45/12 34/601
7,909,939 B2 * 3/2011 Brewer et al. ..... 134/56 D
8,146,265 B2 * 4/2012 Oh ..... D06F 58/22 219/647
8,372,214 B2 * 2/2013 Bittner ..... A47L 15/0081 134/56 D
8,757,179 B2 * 6/2014 Wetzel ..... A47L 15/48 134/102.3
2003/0140517 A1 * 7/2003 Schmid ..... A47L 15/483 34/78
2004/0098878 A1 * 5/2004 Park et al. ..... 34/595
2004/0261820 A1 * 12/2004 Monsrud ..... A47L 15/483 134/10
2006/0101588 A1 * 5/2006 Park ..... D06F 25/00 8/158
2009/0249639 A1 * 10/2009 Kim et al. ..... 34/389
2014/0150286 A1 * 6/2014 Jadhav ..... A47L 15/0034 34/443

FOREIGN PATENT DOCUMENTS

EP 0753282 A1 1/1997
GB GB 2302398 A 1/1997

* cited by examiner

VAPOR REMOVAL SYSTEM

This application claims benefit of and priority to U.S. Provisional Application No. 61/295,291, filed Jan. 15, 2010, and is entitled to that filing date for priority. The specification, figures and complete disclosure of U.S. Provisional Application No. 61/295,291 are incorporated herein by specific reference for all purposes.

FIELD OF INVENTION

This invention relates to an improved method and apparatus for removing water vapor from within commercial washing machines.

BACKGROUND OF THE INVENTION

The use of automated commercial dishwashers, and other washing machines, in a variety of settings, such as restaurants, hotels, or nursing homes, among others, is widely known. A continuing problem is that such dishwashers release heat and vapor into the environment in which they operate. In situations where the operational environment is significantly colder than the operating temperatures of the machine, the vapor released by the machine will often condense on other articles in the immediate area, thereby creating the potential for mold and bacteria growth, as well as contaminated droplets falling onto food or food preparation surfaces.

A solution to the problem has been to provide a ventilation hood above the machine that captures and removes the heated air and vapors released from the dishwasher. This is expensive and not energy efficient due to the fact the typical hood must operate at a minimum of 400 cubic feet per minute to capture the heat and vapor released by the machine. Further, as the air captured by the hood is discharged from the building and new air must be introduced into the building, the new air must be air conditioned before or as it is introduced into the building.

One example of a dishwasher machine with a water vapor vent and recovery system is disclosed in Monsrud, et al., US 2004/0261820 (App. 10/610,330), the complete disclosure of which is specifically incorporated herein by specific reference for all purposes. This system, however, requires a plurality of driver nozzles operating at elevated pressures to pull the vapor from the washing chamber interior. Such systems also can be expensive and not energy efficient.

SUMMARY OF INVENTION

In various embodiments, the present invention comprises a system and apparatus for evacuating warm, moist air or vapor from a dishwasher cabinet or chamber, or other washing machine interior, before the doors are opened, thereby reducing the heat and vapor load applied to the room by the washer. A centrifugal fan creates a vacuum effect in the cooling flue riser, drawing the hot air and water vapor out of the washing cavity through the flue riser. The fan discharges the air and vapor mixture into the cooling flue, which comprises a cooling cabinet or space with one or more cooling spray nozzles. The nozzles may be mounted on a nozzle manifold or may be mounted on a surface of the cooling cabinet.

The cooling spray nozzles spray a fine mist of cold water into the stream of heated air and vapor as it passes the nozzles and manifold. As the heated air and vapor from the dishwasher and the cooling spray mix, heat is transferred from the heated air and vapor to the cold water or mist being sprayed into the air stream. This reduces the temperature of the vapors and air that was extracted from the dishwasher. As the temperature is reduced, the water vapors condense and form droplets which accumulate on the sides and bottom of the cooling flue, thus reducing the heat and moisture content of the air stream. This reduced temperature and moisture air is then discharged to the room at an opening, which may be located slightly above the bottom of the flue cabinet.

The cooling water that has had its temperature increased along with the moisture that was removed from the air stream is drained from the bottom of the device. In one embodiment, the air stream also is discharged along the bottom of the wash cavity. This raises the temperature of the air stream slightly to prevent condensation of any remaining water vapor in the air stream.

In one exemplary embodiment, a door locking mechanism is activated at the start of the dishwashing cycle and released after the vapor removal system has had sufficient time to reduce the heat and vapor load to an acceptable level. Indicator lights or audible signals, or both, may be used to indicate to an operator when the door-interlock is engaged and the system is in operation.

The device may comprise an adjustable timer that will allow it to be configured as needed, based on the machine and location requirements. Additional or different nozzles could be used based on a dishwasher's heat generation characteristics. The system may operate continuously regardless of the dishwasher operation, or may operate in some other relationship to the machine cycle, such as an overlapping cycle, depending on machine and location characteristics.

DETAILED DESCRIPTION OF EXEMPLARY EMBODIMENTS

Figure 1:
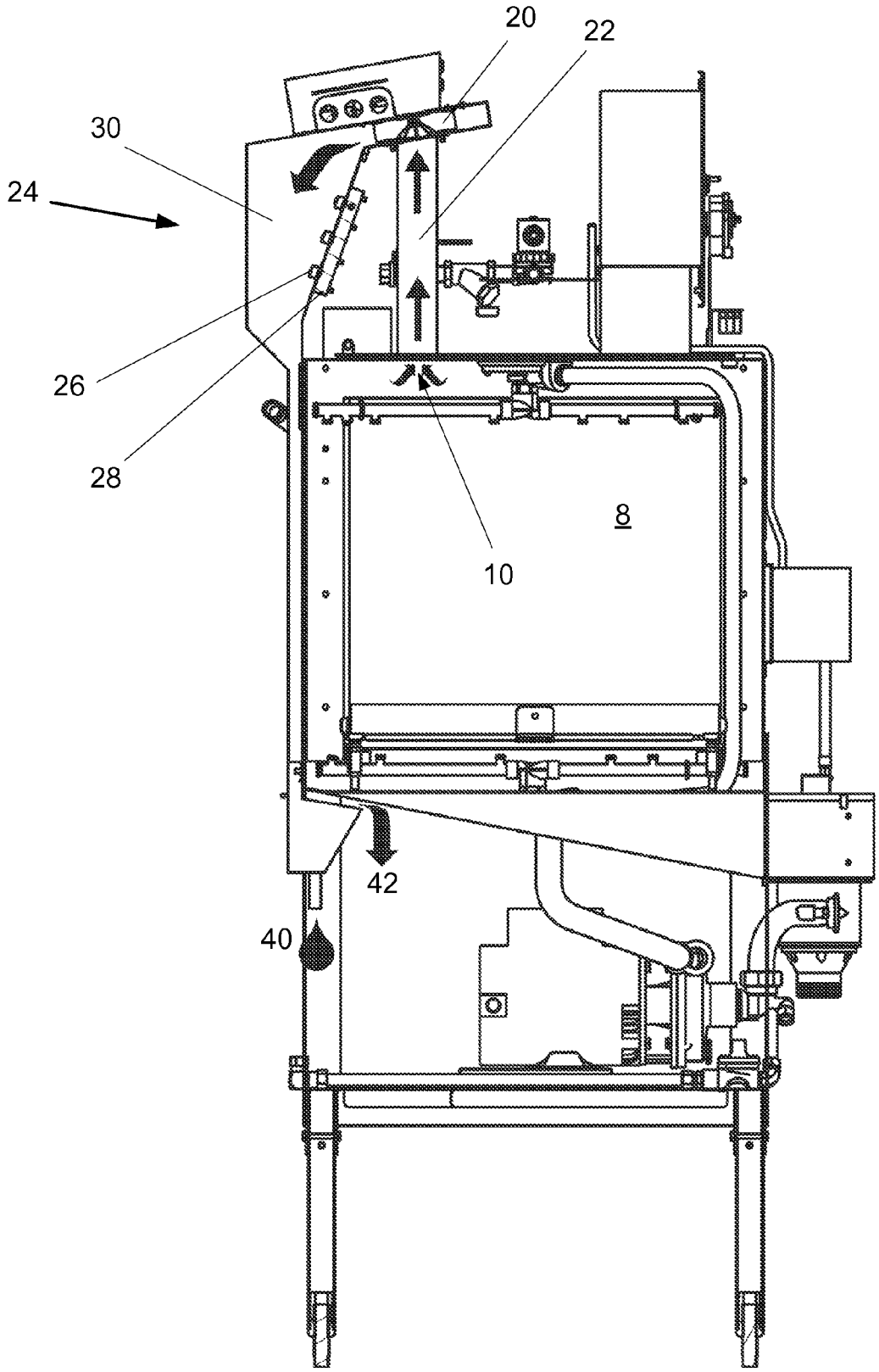
FIG. 1 shows a view of a system in accordance with an exemplary embodiment of the present invention.

In one exemplary embodiment, as shown in FIG. 1, the system of the present invention evacuates warm, moist air or vapor 10 from the dishwasher cabinet 8 before the doors are opened, thereby reducing the heat and vapor load applied to the room by the dishwasher. A centrifugal fan 20 creates a vacuum effect in the cooling flue riser 22, drawing the hot air and water vapor out of the washing cavity through the flue riser 22 and through the fan 20. The fan 20 discharges the air and vapor mixture into the cooling flue 24, which comprises a cooling cabinet or chamber or space 30 with one or more cooling spray nozzles 26. The nozzles 26 may be mounted on a nozzle manifold 28 or may be mounted on a surface of the cooling cabinet or chamber 30.

Figure 3:
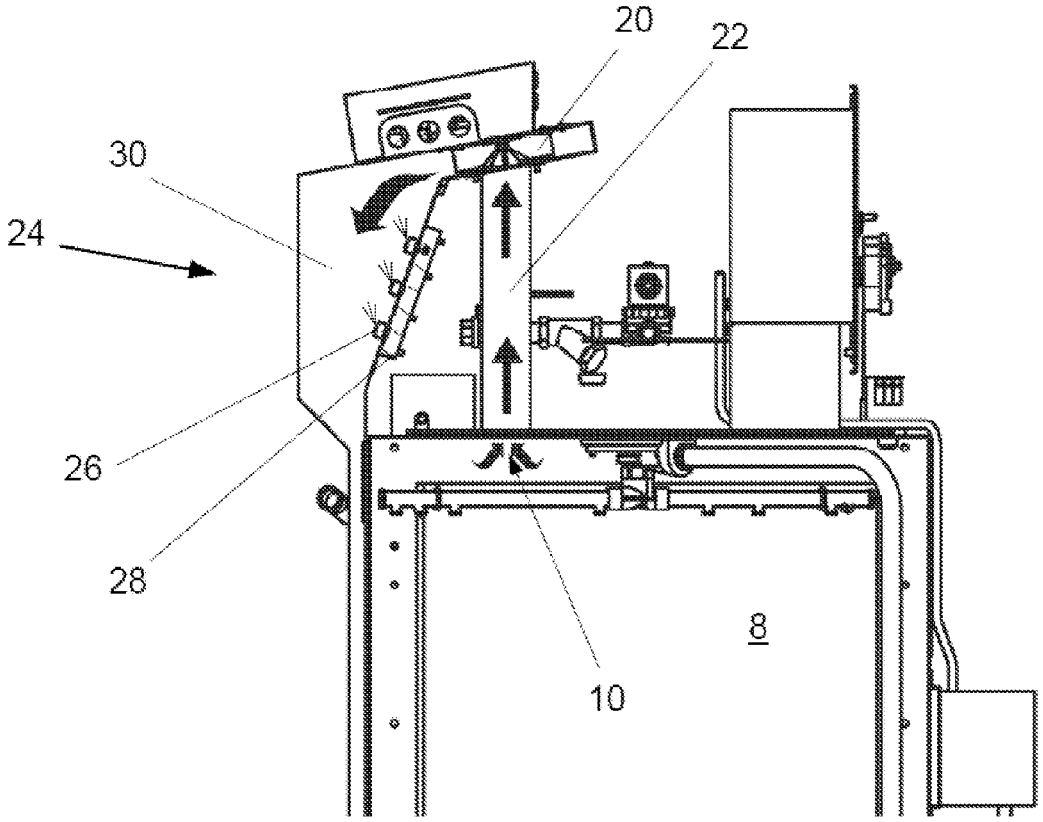
FIG. 3 shows a view of the system of FIG. 1 with nozzle spray at an angle against the flow of air.
Figure 4:
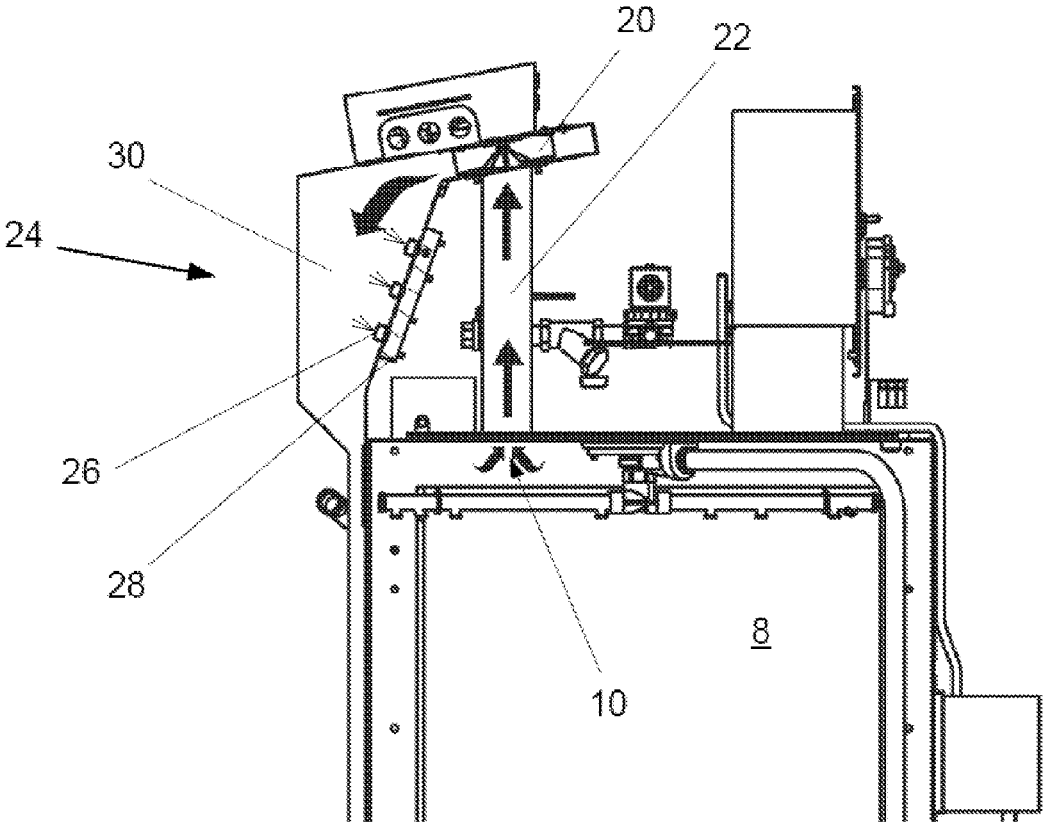
FIG. 4 shows a view of the system of FIG. 1 with nozzle spray at a right angle to the flow of air.
Figure 5:
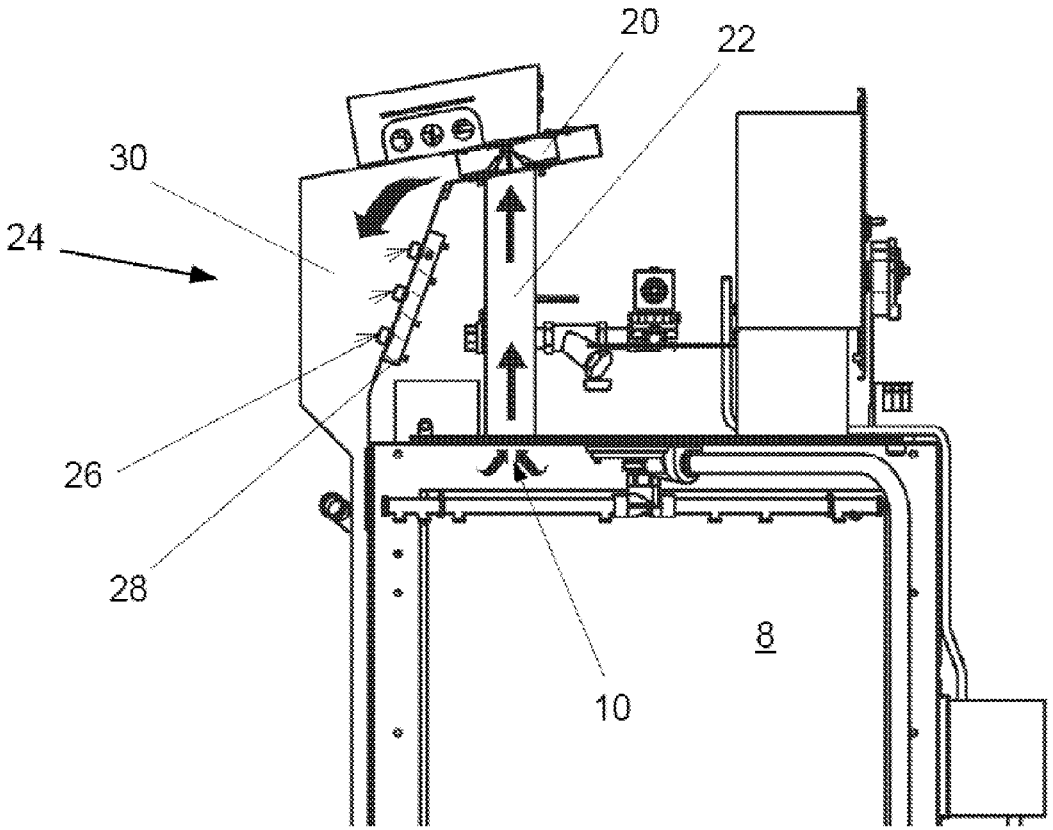
FIG. 5 shows a view of the system of FIG. 1 with nozzle spray at an angle with the flow of air.

The cooling spray nozzles spray a fine mist of cold water into the stream of heated air and vapor as it passes the nozzles 26 and manifold 28. The cooling spray nozzles may spray at angle to the flow of the stream of heated air and vapor. In one exemplary embodiment, the cooling spray nozzles spray at substantially right angles to the flow, as seen in FIG. 4, while in another exemplary embodiment, the cooling spray nozzles may spray at other angles, including angles with or against the flow, as seen in FIGS. 3 and 5. In some embodiments, the nozzles may spray at different angles at different points or locations in the flow.

As the heated air and vapor from the dishwasher and the cooling spray mix, heat is transferred from the heated air and vapor to the cold water or mist being sprayed into the air stream. This reduces the temperature of the vapors and air that was extracted from the dishwasher. As the temperature is reduced, the water vapors condense and form droplets which accumulate on the sides and bottom of the cooling flue, thus reducing the heat and moisture content of the air stream. The droplets run down the inside of the cooling flue, through the lower end 30*a* of the cooling flue, into a collection cup 32.

This reduced temperature and moisture air is discharged to the room at an opening, which may be located slightly above the bottom of the flue cabinet. The cooling water that has had its temperature increased along with the moisture that was removed from the air stream is drained from the bottom 40 of the device or collection cup. In one embodiment, the air stream also is discharged along the bottom of the wash cavity 42. This raises the temperature of the air stream slightly to prevent condensation of any remaining water vapor in the air stream.

In one exemplary embodiment, a door locking mechanism is activated at the start of the dishwashing cycle and released after the vapor removal system has had sufficient time to reduce the heat and vapor load to an acceptable level. Indicator lights 102, 103 or audible signals, or both, may be used to indicate to an operator when the door-interlock is engaged and the system is in operation.

Figure 2:
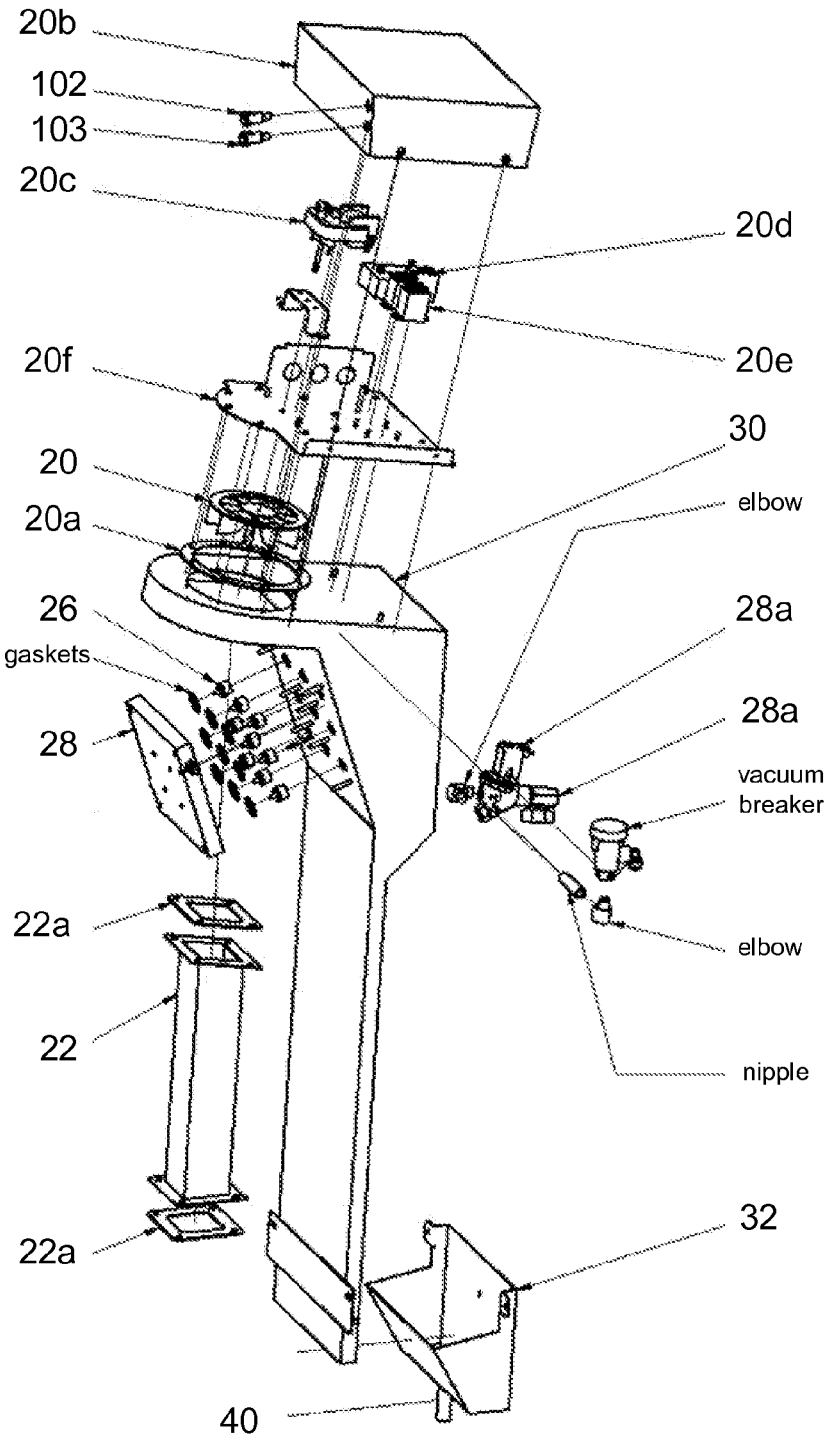
FIG. 2 shows an exploded view of the system of FIG. 1.

FIG. 2 shows a detailed view of certain additional components of an embodiment of the present invention. The flue riser 22 is affixed at top and bottom by means of screws or bolts, and flue riser gaskets 22*a* may be used to effect a tight seal. Similarly, a fan gasket 20*a* may be used with the fan for the same reason. In the embodiment shown, the fan 20 is contained in a top fan housing 20*b*, which also contains a fan motor 20*c*, timer 20*d*, and relay 20*e*, supported on a bracket 20*f*.

The cooling spray is delivered to the spray nozzles 26 in the manifold 28 through means known in the art, such as a fill valve and ball valve assembly 28*a*. The device may comprise an adjustable timer that will allow it to be configured as needed, based on the machine and location requirements. Additional or different nozzles could be used based on a dishwasher's heat generation characteristics. The system may operate continuously regardless of the dishwasher operation, or may operate in some other relationship to the machine cycle, such as an overlapping cycle, depending on machine and location characteristics.

For example, in one embodiment, at the end of the wash and rinse cycle the centrifugal fan operates at 45 cubic feet per minute. There are 9 cooling mist nozzles on a manifold, with an operating pressure of 25 psi water pressure. The nozzles operate for 30 seconds during the cooling cycle. Approximately 0.39 gallons of water per cycle is consumed. The nozzles may operate at ordinary, normal water pressure at most locations.

The amount of water used per cycle depends on the water pressure and duration of the cycle. For a 30 second cycle, 0.48 gallons is consumed at 35 psi, 0.53 gallons is consumed at 45 psi, and 0.61 gallons is consumed at 55 psi. The duration of the cycle may be adjusted where conditions and desired results at a particular installation warrant.

The device of the present invention thus may be equivalent in effect to the installation of a ventilation hood above a dishwasher. The present invention may also be used with other types of washing machines.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. A vapor removal apparatus for a washing machine with a top and a bottom, comprising:

a flue riser with a top and a bottom, the flue riser bottom affixed to an air discharge opening in the top of the washing machine and extending vertically upward therefrom to a fan housing affixed to the flue riser top;

a fan disposed in the fan housing, configured to pull air from the washing machine up through the flue riser;

a cooling chamber with a top and a bottom, with an inlet at the top and an outlet at the bottom, wherein the inlet is affixed to the fan housing and is adapted to receive discharged air from the fan housing; and a plurality of nozzles in the interior of the cooling chamber, said nozzles configured to spray a mist of cold water into the discharged air as it flows from the inlet to the outlet to promote the formation of condensate from the discharged air, wherein the water and condensate are discharged through the bottom outlet;

further wherein said plurality of nozzles comprising an array of nine nozzles; and further wherein the outlet at the bottom of the cooling chamber is configured to raise the temperature of the discharged air to prevent any remaining water vapor in the discharged air by the joint discharge of water, condensate, and discharged air through the bottom outlet.

2. The apparatus of claim 1, wherein at least some of the nozzles are mounted on a nozzle manifold.

3. The apparatus of claim 1, wherein at least some of the nozzles are mounted on an interior wall of the cooling chamber.

4. The apparatus of claim 1, wherein at least some of the nozzles are mounted to spray at substantially a 90 degree angle to the flow of the air.

5. The apparatus of claim 1, wherein at least some of the nozzles are mounted to spray at an angle against the flow of the air.

6. The apparatus of claim 1, wherein condensation formed from the mixing of the sprayed mist and the discharged air accumulates on the inside of the cooling chamber and is discharged as a fluid from the bottom of the cooling chamber.

7. The apparatus of claim 6, wherein the condensed fluid is discharged in conjunction with the discharged air stream.

8. A vapor removal apparatus for a washing machine with a top and a bottom, comprising:

a flue riser with a top and a bottom, the flue riser bottom affixed to an air discharge opening in the top of the washing machine and extending vertically upward therefrom to a fan housing affixed to the flue riser top;

a fan disposed in the fan housing, configured to pull air from the washing machine up through the flue riser;

a cooling chamber with a top and a bottom, with an inlet at the top and an outlet at the bottom, is affixed to the fan housing and is adapted to receive discharged air from the fan housing; and a plurality of nozzles in the interior of the cooling chamber, said nozzles positioned to spray a mist of cold water into the discharged air as it flows from the inlet to the outlet to promote the formation of condensate from the discharged air, wherein the water and condensate are discharged through the bottom outlet;

wherein some or all of said nozzles are mounted to spray at an acute angle into the flow of the air to promote the formation of condensate in the cooling chamber.

* * * * *